US008116499B2

(12) United States Patent
Grant et al.

(10) Patent No.: US 8,116,499 B2
(45) Date of Patent: Feb. 14, 2012

(54) MICROPHONE ADAPTOR FOR ALTERING THE GEOMETRY OF A MICROPHONE WITHOUT ALTERING ITS FREQUENCY RESPONSE CHARACTERISTICS

(76) Inventors: John Grant, Baltimore, MD (US); Antonino Correlli, Baltimore, MD (US)

( * ) Notice: Subject to any disclaimer, the term of this patent is extended or adjusted under 35 U.S.C. 154(b) by 584 days.

(21) Appl. No.: 12/321,624

(22) Filed: Jan. 23, 2009

(65) Prior Publication Data

US 2010/0189299 A1 Jul. 29, 2010

(51) Int. Cl.
*H04R 1/38* (2006.01)

(52) U.S. Cl. ..... 381/358; 381/351; 381/360; 381/361; 381/366

(58) Field of Classification Search ..... 181/22, 181/159, 160; 381/338, 345, 351, 355–358, 381/360, 361, 363, 366, 386, 395
See application file for complete search history.

(56) References Cited

U.S. PATENT DOCUMENTS

| | | | | |
|---|---|---|---|---|
| 3,240,883 | A | 3/1966 | Seeler | 179/115.5 |
| 3,766,333 | A | 10/1973 | Watson | 179/115.5 |
| 3,903,989 | A | 9/1975 | Bauer | 181/144 |
| 3,989,905 | A | 11/1976 | Anderson et al. | 179/121 |
| D475,699 | S | 6/2003 | Thorton et al. | D14/228 |
| 6,674,870 | B1 * | 1/2004 | Price | 381/361 |
| 7,783,069 | B1 * | 8/2010 | Miller et al. | 381/354 |
| 2002/0141608 | A1 * | 10/2002 | Moquin et al. | 381/361 |

* cited by examiner

*Primary Examiner* — Ha Tran T Nguyen
*Assistant Examiner* — Raj R Gupta
(74) *Attorney, Agent, or Firm* — Larry J. Guffey

(57) ABSTRACT

A method of improving the "tight space" usefulness of a unidirectional microphone of the type having an otherwise screw-together headpiece and handle, includes the steps of: (a) fabricating an adapter having male- and female-threaded ends and a cavity of a specified volume that extends between these ends, and where each of these ends has a centerline and these intersect at a prescribed angle, (b) fabricating the adapter's cavity so that its volume is approximately equivalent to that of the volume of handle's acoustic chamber, and (c) connecting the adapter's male-threaded end to the handle and its female-threaded end to the headpiece in such a manner as to not appreciably change the frequency response characteristics of the microphone.

4 Claims, 4 Drawing Sheets

MICROPHONE ADAPTOR FOR ALTERING THE GEOMETRY OF A MICROPHONE WITHOUT ALTERING ITS FREQUENCY RESPONSE CHARACTERISTICS

BACKGROUND OF THE INVENTION

1. Field of the Invention

This invention relates to electrical audio signal processing devices. More particularly, this invention relates to unidirectional, dynamic microphones that are used for musical instrument pickup or vocals.

2. Description of the Related Art

Unidirectional microphones are well known and widely used in the music industry. One of the most popular and widely used of these microphones is the SHURE® SM57 which effectively presents a cardioid sound pickup pattern directly in front of the microphone while minimizing the background sound coming from other directions. The unidirectional technology of this microphone is generally described in U.S. Pat. No. 3,240,883, the contents of which are included herein by reference as they help to provide a significant part of the technical background for the present invention.

Despite the popularity of the SM57 microphone, some problems have been encountered in its use. For example, its tubular and elongated shape that stretches to a length of approximately 10 inches often makes it difficult for sound engineers to mount and properly position it when they are trying to fit the SM57 into tight spaces for recording or live performances of various types of musical instruments (e.g., drum kits, and a snare drum in particular).

To remedy this SM57 mounting problem, it was suggested to its maker that they modify the SM57 so as to change its current, tubular and elongated shape so as to instead give it an L-shaped configuration which would reduce the effective length of this microphone. The maker of the SM57 responded by noting this could not be done because such a modification would adversely affect the frequency response of the microphone since it has a handle acoustic chamber, formed by the union of the microphone's headpiece and handle or base, that would not perform as designed if this acoustic chamber were to be changed. Rather than change the exterior shape of the SM57, its maker proposed that one who is confronted with SM57 mounting problems should instead consider changing to one of their other shorter length, commercially available microphones (e.g., Beta 56) which reportedly have similar frequency response characteristics to the SM57 and invariably are more expensive that the SM57 microphone.

However, even if these alternative microphones were to perform as suggested, they still might not be the ideal solution for many sound engineers, especially those who have ready access to the less expensive SM57s and are dedicated to them because of their perceived superior performance over other microphone alternatives.

Thus, despite the wide spread use of SM57 microphones, it does appear that their "tight space" usefulness could be improved upon if their shape could be modified so that they were more easily mountable in such situations.

SUMMARY OF THE INVENTION

Recognizing the need for the development of a means for improving the "tight space" usefulness of the popular SM57 microphones, the present invention is generally directed to satisfying the needs set forth above and overcoming the identified disadvantages of SM57 microphones.

In accordance with the present invention, an improved unidirectional microphone having desired frequency response characteristics (i.e., of the type having a headpiece and a handle, with the headpiece including a male-threaded, rear end, a diaphragm, a first acoustic chamber situated behind the diaphragm, a microphone cartridge assembly and a second acoustic chamber, an opening for a first acoustical path that directs sound onto the front of the diaphragm, circumferentially disposed and rearward facing openings that begin a second acoustical path that directs sound into the first acoustic chamber, and the handle including a female-threaded, front end, a transformer and a third acoustic chamber of a specified volume that is situated in front of the transformer, and a third acoustical path that directs sound between the acoustic chambers, and wherein the threaded ends are such that the headpiece and handle are screw connectable at their threaded ends) includes an adapter that has a male-threaded and a female-threaded end and a cavity of a specified volume that extends between its ends.

Each of the adapter's ends has a centerline and these intersect at a prescribed angle, and the volume of the adapter's cavity is made approximately equivalent to that of the third acoustic chamber in order to avoid any significant changes in this microphone's desired frequency response characteristics when the adapter's male- and female-threaded ends are screw connected to the handle and the headpiece respectively.

Alternatively, the present invention takes the form of a method of improving the "tight space" usefulness of such a unidirectional microphone. This method includes the steps of: (a) fabricating an adapter having a male- and female-threaded ends and a cavity of a specified volume that extends between these ends, and where each of these ends has a centerline and these intersect at a prescribed angle, (b) fabricating the adapter's cavity so that its volume is approximately equivalent to that of the microphone's third acoustic chamber's volume, and (c) connecting the adapter's male-threaded end to the handle and its female-threaded end to the headpiece in such a manner as to not appreciably change the frequency response characteristics of the microphone.

Thus, there has been summarized above, rather broadly and understanding that there are other preferred embodiments which have not been summarized above, the present invention in order that the detailed description that follows may be better understood and appreciated. There are, of course, additional features of the invention that will be described hereinafter and which will form the subject matter of the later presented claims to this invention.

DESCRIPTION OF THE PREFERRED EMBODIMENT

Figure 1:
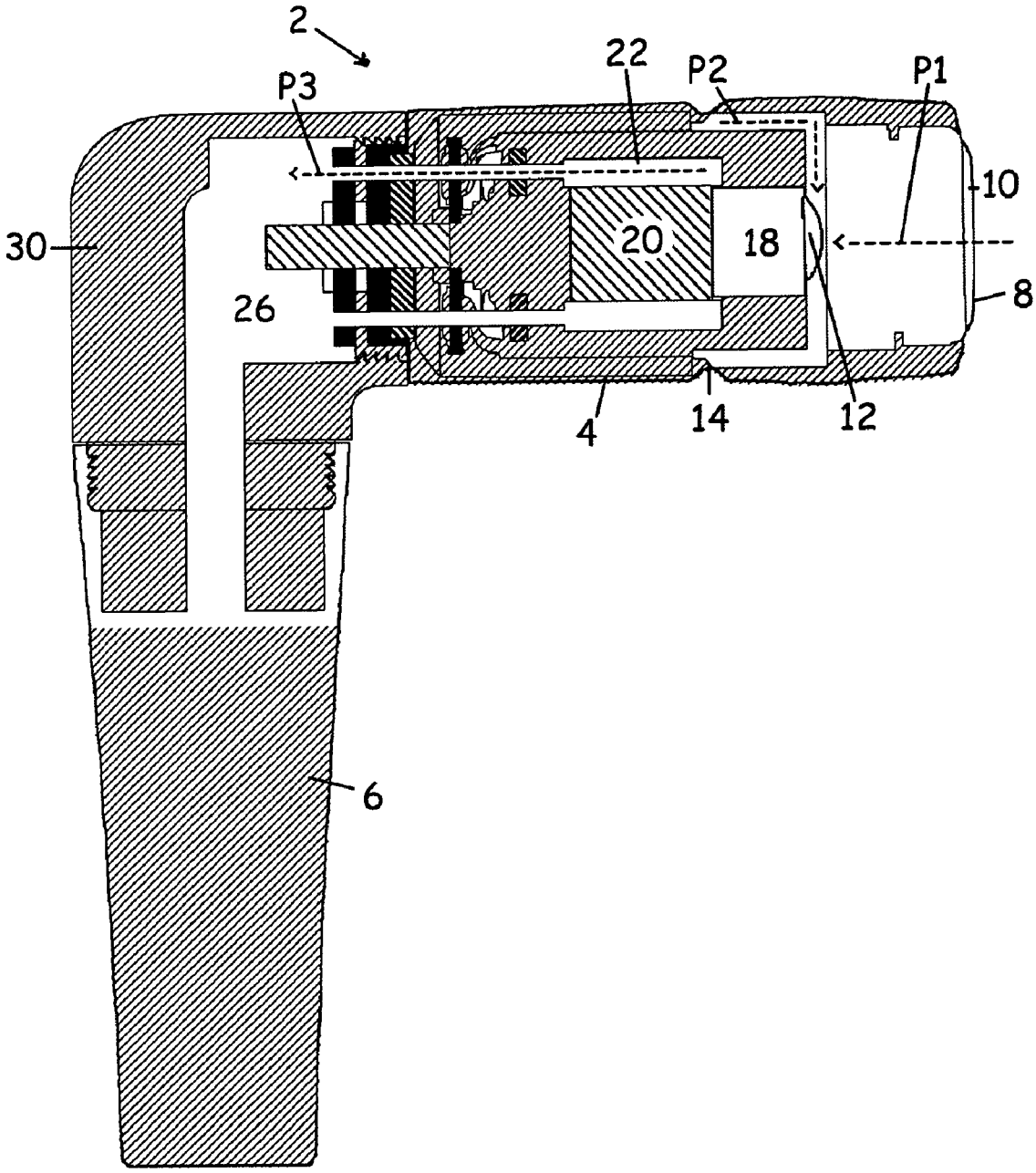
FIG. 1 is a cross-sectional view of a preferred embodiment of the present invention.
Figure 2B:
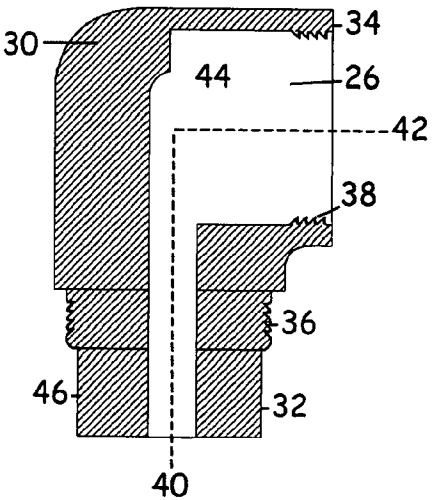
FIG. 2B show a side cross-sectional view of the adapter shown in FIG. 2A.
Figure 2D:
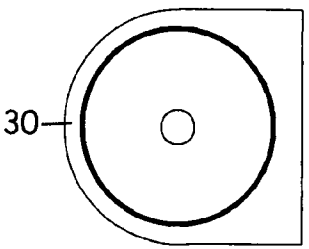
FIG. 2D show the end view of the male end of the adapter shown in FIG. 2A.
Figure 2A:
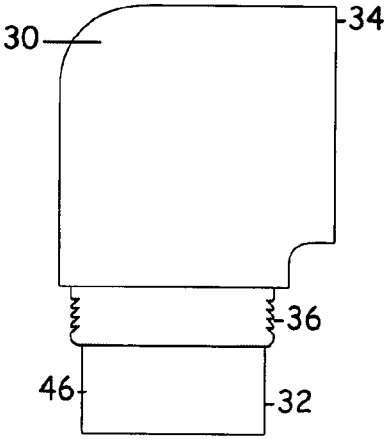
FIG. 2A show a side view of a 90 degree adapter that is utilized in a preferred embodiment of the present invention.
Figure 2C:
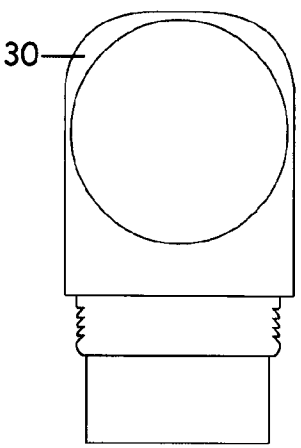
FIG. 2C show the end view of the female end of the adapter shown in FIG. 2A.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Since an objective of the present invention is to provide a microphone that has the same frequency response characteristics as an SM57 microphone, but which is easier to mount in tight spaces than a SM57 microphone, it is instructive to review and understand the workings of the SM57 microphone in some detail.

A quick examination of this microphone and the teaching related to it in is U.S. Pat. No. 3,240,883 disclose that the SM57 microphone has a two-part housing that consists of a generally tubular headpiece and a generally tubular handle or base that are screwed together via a male thread that exists on the outside edge of bottom of the headpiece and a female thread that is on the inside of the top part of the handle.

Unscrewing these parts reveals that electrical wires extend between the headpiece and the handle to connect a microphone cartridge assembly that is mounted in the headpiece with a microphone transformer that is mounted in the handle and from which an electrical connection can be made to the system that is to receive the signals from the microphone. There is a void area between the union of these parts that forms a base acoustic chamber.

The microphone cartridge assembly consists of a magnet that includes an air gap in which is situated a voice coil whose movement serves to generate an e.m.f. that excites the transformer's primary winding via the electrical connections that exist between these elements. The voice coil is connected to a diaphragm that essentially covers the top of the headpiece and is constructed of a thin, flexible porous material that vibrates when sound waves impact upon it. A perforated screen and a protective, porous resonator plate are mounted in front of the diaphragm. The microphone's perforated screen and resonator plate provide for an acoustical path to the front surface of the microphone's diaphragm.

This headpiece also has a plurality of circumferentially disposed, radial openings at its rear end which provide the entrance for a second acoustical path through which sound may impact upon the microphone's diaphragm. The sound which enters through these rearward-facing, radial openings is transmitted to a diaphragm acoustic chamber that exists behind the rear surface of the microphone's diaphragm.

Additionally, this microphone has a third acoustical path that extends from this diaphragm acoustic chamber, through the voice coil and into a headpiece acoustic chamber that is situated in the rear end of the headpiece and behind its microphone cartridge assembly. Apertures in a mounting ring, which forms the bottom of the headpiece and serves to help mount the various parts of the headpiece, allow this third acoustical path to be extended so that it connects the headpiece acoustic chamber with the base's acoustic chamber.

It is this microphone's unique arrangement of three acoustical paths and three separate acoustical chambers which gives the microphone its distinct, unidirectional sound pickup capabilities.

In trying to modify the SM57 microphone so as to give it a modified shape that would make it more easily mountable in tight space situations, many different modified shape configurations were considered. For example, an attempt was made to directly modify an SM57 microphone by disconnecting its headpiece and base and inserting between them an especially machined 90 degree adapter which had a female interior thread at one end that was configured to join with the exterior male threads of an SM57's headpiece. The other end of this adapter was given an exterior male tread that allowed it to join with the base's interior female threads. The interior diameter of this adapter was approximately the same size as that of the diameter of the base's acoustic chamber and its overall length was made as short as possible while allowing enough room for the threads at either end that were necessary to allow for the attachment of the SM57's headpiece and base. However, when such a prototype microphone (i.e., an SM57 headpiece and base that are connected at right angles by the inserted "uniform interior diameter," 90 degree adapter and the electrical connections between the microphone's cartridge assembly and transformer reconnected) was tested for its frequency response characteristics, these were found to be significantly different than those of the original SM57 microphone (e.g., a 4 dB drop at certain flow frequencies). This began a series of experimental fabrications of 90 degree adapters in which the interior diameter and lengths of these adapters were varied and their frequency response performances measured when they were alternatively inserted between an SM57 headpiece and base. After fabricating and testing many adapters, it was found possible to optimally configure one which has also the identical frequency response characteristics as that of the original SM57 microphone FIG. 1 shows a preferred embodiment of the present invention 2. Its headpiece 4 and base or handle 6 are made identical to that of the SM57 microphone. Thus, its headpiece is generally tubular shaped and is enclosed at its front end 8 by a perforated screen 10 that provides forward-facing openings for sound waves approaching the front of the screen to begin a first acoustical path P1 that leads to the front surface of a diaphragm 12. Circumferentially disposed, radial openings 14 at the headpiece's approximate midpoint provide the entrance for sound waves coming from the rear of the microphone to begin a second acoustical path P2 that leads to the rear of the diaphragm and a diaphragm or first acoustic chamber 18 that exists behind the rear surface of the microphone's diaphragm. Behind the headpiece's diaphragm is a microphone cartridge assembly 20 consists of a magnet that includes an air gap in which is situated a voice coil that is connected to the diaphragm. This air gap forms part of a headpiece or second acoustic chamber 22 that is situated in the rear end of the headpiece and behind its microphone cartridge assembly. A mounting ring forms the bottom of the headpiece and serves to help mount the various parts of the headpiece. The back end of the headpiece has a male thread on its exterior surface which allows it to be joined by a screw connection to the present invention's required 90 degree adapter 30.

The handle or base 6 of this preferred embodiment is generally tubular and has a female thread on the top inside surface. This base is sized such that it can contain the microphone's transformer. A void at the front end of the base provides the space that is required for the junction with this microphone's 90 degree adapter 30 and some of the space that eventually serves as a modified handle or base or third acoustic chamber 26. Apertures in the headpiece's mounting ring connect the headpiece's and the base's acoustic chambers.

FIGS. 2A-2D show various exterior views and a cross-sectional view of the 90 degree, tubular-shaped adapter 30 of the present invention. This adapter has male 32 and female 34 ends that have screw threads 36, 38 or fittings that are made to allow for the joining of this adapter to the microphone's respective threaded base and headpiece. Each of the adapter's ends has a centerline 40, 42 and these bisect each other at an approximately 90 degree angle. A two-part cavity 44 extends between the adapter's ends and provides a passage where the microphone's necessary electrical connections between its headpiece and base can be situated. This cavity 44 can be seen, as a result of the discussion that follows, to also serve as the base's acoustic chamber and, via the apertures or openings in the headpiece's mounting ring, to provide the microphone, similarly to the SM57, with the beginnings of a third acoustical path P3 that extends from its diaphragm and diaphragm acoustic chamber through to its base's acoustic chamber.

The diameter of the adapter's cavity at its female end is approximately the same as that of the original base's acoustic chamber (e.g., 1.05 inches). At its male end, the diameter of this cavity is considerably narrower (e.g., 0.3 inches). The depth of the cavity at the adapter's female end extends inward until approximately the back of this cavity approximately coincides with the centerline from the male end of the adapter. Similarly, the depth of the cavity at the adapter's male end extends inward until the back of this cavity approximately coincides approximately with the centerline from the female end of the adapter. Also, the threads on the adapter's male end are seen to be not situated on the very end of the adapter (although we still speak of this end of the adapter as being the "male threaded end), but to be situated a bit forward of this point (e.g., 0.35 inches) so as to form an effective extension portion 46 that fits down into the original base such that it effectively fills the original base acoustic cavity.

Figure 3:
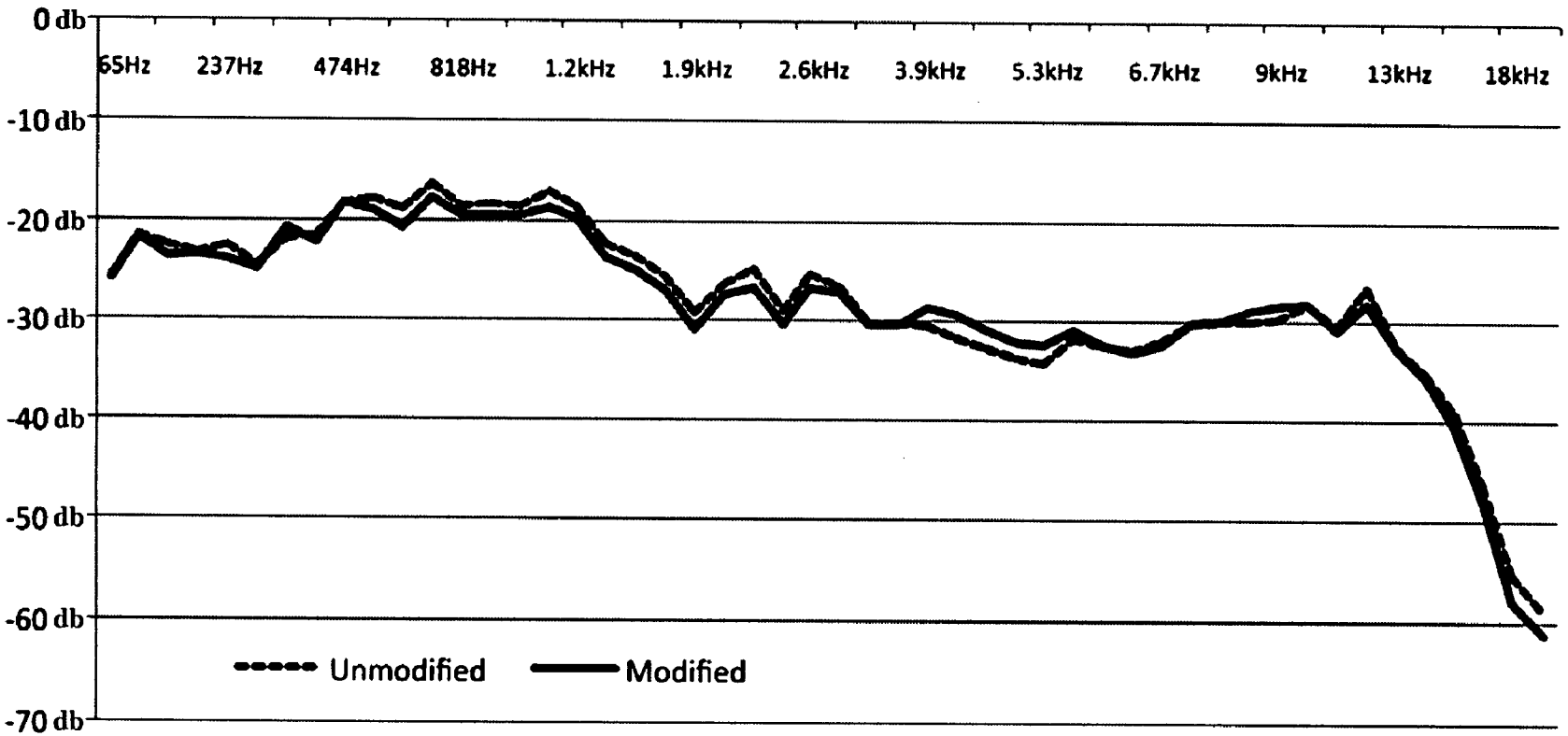
FIG. 3 compares the frequency response characteristics of the preferred embodiment shown in FIG. 1 with those of a standard SM57 microphone.

The frequency response characteristics of this preferred embodiment, when it utilizes an adapter that was machined from aluminum, were found, when tested, to be almost identical to those of the original SM57 microphone, see FIG. 3. A similarly shaped plastic adapter when used with an identical SM57 crafted headpiece and handle show significant decibel losses at the lower frequencies.

The keys that allowed the present invention to essentially reproduce the frequency response characteristics of an SM57 microphone appear to be the use of an adapter than is made from a sufficiently stiff and dense material and which has a two-part cavity whose total volume is approximately equivalent to that of the acoustic chamber found in the handle or base of a SM57 microphone.

Figure 4A:
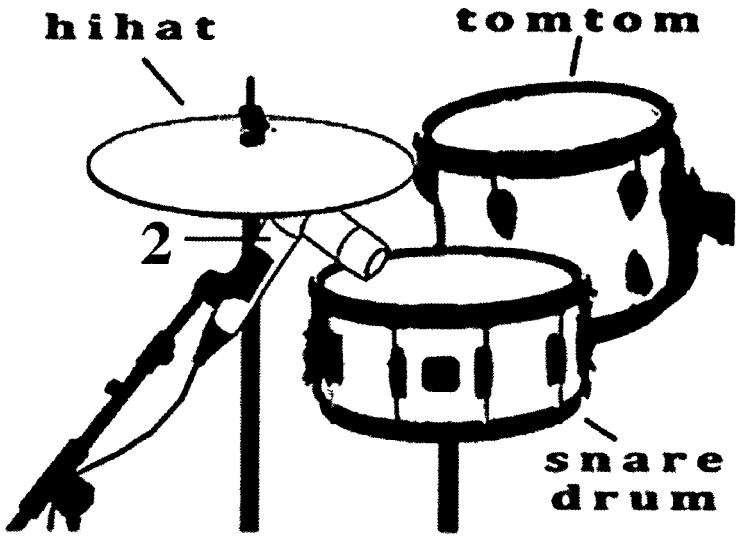
FIG. 4A shows a preferred embodiment of the present invention being situated in a first representative, tight area that will not accommodate a SM57 microphone, i.e., over a snare drum in a position that doesn't obstruct the drummer while minimizing the input from the hihat beneath which the microphone is partially mounted.
Figure 4B:
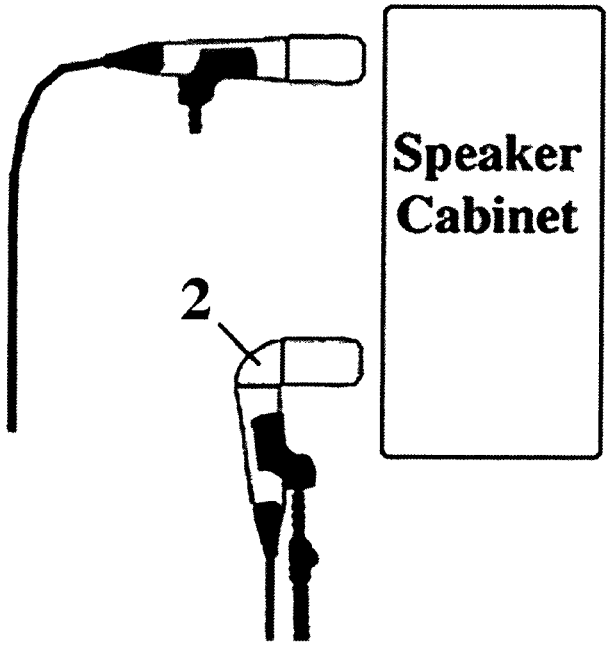
FIG. 4B shows a preferred embodiment of the present invention being situated in a second representative, tight area that will not accommodate a SM57 microphone, i.e., in front and aimed directly at a speaker cabinet where the present embodiment's reduced length means that it presents less of a tripping hazard than a SM57 microphone.

Examples which display this preferred embodiment of the present invention mounted in typical "tight" musical areas that cannot accommodate an SM57 microphone are shown in FIG. 4A (over a snare drum in a position that doesn't obstruct the drummer while minimizing the input from the hihat beneath which the microphone is partially mounted) and 4B (in front and aimed directly at a speaker cabinet where its reduced length means that it presents less of a tripping hazard than a SM57 microphone).

The foregoing is considered as illustrative only of the principles of the present invention. Further, since numerous modifications and changes will readily occur to those skilled in the art (e.g., the centerlines of the adapter's ends could intersect at desired angles other than that of 90 degrees; either the headpiece or the handle could be given the male-threaded end and vice versa with the handle), and because of the wide extent of the teachings disclosed herein, the foregoing disclosure should not be considered to limit the invention to the exact construction and operation shown and described herein. Accordingly, all suitable modifications and equivalents of the present disclosure may be resorted to and still considered to fall within the scope of the invention as will be later set forth in claims to the present invention.

We claim:

1. An improved unidirectional microphone having desired frequency response characteristics and of the type having a headpiece and a handle, with said headpiece including a male-threaded rear end, a diaphragm, a microphone cartridge assembly, a forward facing opening for a first acoustical path that directs sound onto the front of said diaphragm, a rearward facing opening that begin a second acoustical path that s directs sound onto the rear of said diaphragm, and said handle including a female-threaded front end, an acoustic chamber of a specified volume that is situated in the front of said handle, and an opening for the beginning of a third acoustical path that directs sound between said acoustic chamber and said diaphragm, and wherein said threaded ends are such that said headpiece and handle are screw connectable at said threaded ends, wherein the improvement comprising:

an adapter having a male-threaded and a female-threaded end and a cavity of a specified volume that extends between said ends, each of said ends having a centerline and said centerlines intersecting at a prescribed angle, and wherein said handle acoustic chamber and cavity specified volumes are approximately equivalent and said adapter male-threaded end is screw connected to said handle front end and said adapter female-threaded end is screw connected to said headpiece rear end in such a manner as to not appreciably change said desired frequency response characteristics of said microphone.

2. The improved unidirectional microphone as recited in claim 1, wherein said prescribed angle is approximately ninety degrees.

3. A method of improving a unidirectional microphone having desired frequency response characteristics, said microphone of the type having a headpiece and a handle, with said headpiece including a male-threaded rear end, a diaphragm, a microphone cartridge assembly, a forward facing opening for a first acoustical path that directs sound onto the front of said diaphragm, a rearward facing opening that begin a second acoustical path that directs sound onto the rear of said diaphragm, and said handle including a female-threaded front end, an acoustic chamber of a specified volume that is situated in the front of said handle, and an opening for the beginning of a third acoustical path that directs sound between said acoustic chamber and said diaphragm, and wherein said threaded ends are such that said headpiece and handle are screw connectable at said threaded ends, wherein said method comprising the steps of:

fabricating an adapter having a male-threaded and a female-threaded end and a cavity of a specified volume that extends between said ends, each of said ends having a centerline and said centerlines intersecting at a prescribed angle, fabricating said adapter cavity so that its volume is approximately equivalent to that of said handle acoustic chamber volume, connecting said adapter male-threaded end to said handle front end, and connecting said adapter female-threaded end to said headpiece rear end in such a manner as to not appreciably change said desired frequency response characteristics of said microphone.

4. The method as recited in claim 3, wherein said prescribed angle is approximately ninety degrees.

* * * * *